US010062974B2

(12) United States Patent
Okamoto et al.

(10) Patent No.: US 10,062,974 B2
(45) Date of Patent: Aug. 28, 2018

(54) CONNECTOR

(71) Applicant: Sumitomo Wiring Systems, Ltd., Yokkaichi, Mie (JP)

(72) Inventors: Masaki Okamoto, Mie (JP); Masaaki Kobayashi, Mie (JP); Yasushi Okayasu, Mie (JP); Masaru Kitagawa, Mie (JP)

(73) Assignee: Sumitomo Wiring Systems, Ltd (JP)

( * ) Notice: Subject to any disclaimer, the term of this patent is extended or adjusted under 35 U.S.C. 154(b) by 0 days.

(21) Appl. No.: 15/563,691

(22) PCT Filed: Apr. 6, 2016

(86) PCT No.: PCT/JP2016/061202
§ 371 (c)(1),
(2) Date: Oct. 2, 2017

(87) PCT Pub. No.: WO2016/170977
PCT Pub. Date: Oct. 27, 2016

(65) Prior Publication Data

US 2018/0076534 A1 Mar. 15, 2018

(30) Foreign Application Priority Data

Apr. 23, 2015 (JP) ..... 2015-088109

(51) Int. Cl.
*H01R 4/30* (2006.01)
*H01R 13/639* (2006.01)
(Continued)

(52) U.S. Cl.
CPC ..... *H01R 4/30* (2013.01); *H01R 13/516* (2013.01); *H01R 13/52* (2013.01);
(Continued)

(58) Field of Classification Search
CPC ..... H01R 4/30; H01R 11/26; H01R 11/12
(Continued)

(56) References Cited

U.S. PATENT DOCUMENTS 6,464,538 B2 * 10/2002 Miyazaki ..... H01R 13/6589 439/607.44
6,583,352 B2 * 6/2003 Fukushima ..... H01R 9/032 174/373
(Continued)

FOREIGN PATENT DOCUMENTS

JP 7-222392 8/1995
JP 2008-178267 7/2008
(Continued)

OTHER PUBLICATIONS

International Search Report dated Jul. 5, 2016.
European Search Report dated Feb. 23, 2018.

*Primary Examiner* — Neil Abrams
(74) *Attorney, Agent, or Firm* — Gerald E. Hespos; Michael J. Porco; Matthew T. Hespos

(57) ABSTRACT

A connector 10 disclosed by this specification is a connector 10 to be mounted on a casing 1 of a device by being inserted into a mounting hole 2 provided in the casing 1 and includes a terminal 40 connected to a wire W, a housing 20 having the terminal 40 mounted therein, and an intermediate terminal 30 made of metal, mounted in the housing 20 and disposed between the terminal 40 and a mating terminal 4 in the casing 1. A fastened component (nut 5) disposed in the casing 1 and to be fastened to a fastening component (bolt B), the mating terminal 4, the intermediate terminal 30 and the terminal 40 are arranged side by side in a fastening direction, and the terminal 40 and the mating terminal 4 are connected via the intermediate terminal 30 by being collectively fastened by the fastening component and the fastened component.

5 Claims, 14 Drawing Sheets

(51) Int. Cl.
*H01R 13/6598* (2011.01)
*H01R 13/516* (2006.01)
*H01R 43/20* (2006.01)
*H01R 13/52* (2006.01)
*H01R 13/6581* (2011.01)
*H01R 12/71* (2011.01)

(52) U.S. Cl.
CPC ..... *H01R 13/6397* (2013.01); *H01R 13/6581* (2013.01); *H01R 13/6598* (2013.01); *H01R 43/20* (2013.01); *H01R 12/716* (2013.01)

(58) Field of Classification Search
USPC ..... 439/801, 883
See application file for complete search history.

(56) References Cited

U.S. PATENT DOCUMENTS 6,655,989 B1 12/2003 Gale et al.
6,702,612 B2 * 3/2004 Miyazaki ..... H01R 13/521 439/559
6,837,728 B2 * 1/2005 Miyazaki ..... H01R 9/032 439/271
6,921,292 B2 * 7/2005 Miyazaki ..... H01R 9/032 439/564
7,059,918 B2 * 6/2006 Matsumoto ..... B60L 11/1898 439/752
7,077,676 B2 * 7/2006 Matsumoto ..... H01R 13/5205 439/271
7,094,098 B2 * 8/2006 Miyazaki ..... H01R 4/46 439/550
7,094,970 B2 * 8/2006 Kihira ..... B60L 11/1803 174/74 R
7,097,498 B2 * 8/2006 Miyazaki ..... H01R 4/46 439/362
7,189,117 B2 * 3/2007 Kawamura ..... H01R 9/032 439/607.48
7,264,506 B2 * 9/2007 Mori ..... H01R 11/03 439/559
7,306,475 B2 * 12/2007 Tsuruta ..... H01R 4/30 439/364
7,530,843 B1 * 5/2009 Tesfay ..... H01R 4/183 439/587
7,572,150 B2 * 8/2009 Matsuoka ..... H01R 13/207 439/626
7,597,580 B1 * 10/2009 Advey ..... H01R 13/502 439/272
7,614,910 B2 * 11/2009 Croteau ..... H01R 13/512 439/559
7,618,286 B2 * 11/2009 Aoki ..... H01R 13/5205 439/587
7,628,650 B2 * 12/2009 Aoki ..... H02G 3/0683 439/607.28
7,959,469 B2 * 6/2011 Kawamura ..... H01R 13/6593 439/573
7,988,475 B2 * 8/2011 Sakakura ..... H01R 9/032 439/271
8,083,540 B1 * 12/2011 Spicer ..... H02S 40/34 439/460
8,152,574 B2 * 4/2012 Matsuoka ..... H01R 4/302 439/587
8,251,756 B2 * 8/2012 Matsuoka ..... H01R 9/18 439/737
8,342,880 B2 * 1/2013 Kato ..... H01R 9/032 439/382
8,366,470 B2 * 2/2013 Sakakura ..... H01R 4/34 439/272
8,393,911 B2 * 3/2013 Aoki ..... H01R 13/5205 439/272
8,425,256 B2 * 4/2013 Aoki ..... H01R 13/688 439/620.26
8,466,586 B2 * 6/2013 Tarchinski ..... B60K 6/46 180/65.1
8,485,844 B2 * 7/2013 Omae ..... H01R 13/5202 439/559
8,545,265 B2 * 10/2013 Sakamoto ..... B29C 45/14 439/606
8,562,377 B2 * 10/2013 Kawamura ..... H01R 9/032 439/607.44
8,602,823 B2 * 12/2013 Jimbo ..... H01R 13/6592 439/607.5
8,648,507 B2 * 2/2014 Chamberlin ..... H02K 5/225 310/71
8,672,700 B2 * 3/2014 Matsumoto ..... H01M 2/20 439/364
8,672,706 B2 * 3/2014 Matsumoto ..... H01R 13/447 439/489
8,790,135 B2 * 7/2014 Maegawa ..... H01R 43/24 439/246
8,851,935 B2 * 10/2014 Yoshioka ..... H01R 4/023 439/604
8,992,249 B2 * 3/2015 Kobayashi ..... H01R 13/6591 439/362
9,004,928 B2 * 4/2015 Tanaka ..... B60L 3/0069 439/86
9,022,794 B2 * 5/2015 Wang ..... H01R 13/5202 439/271
9,022,807 B2 * 5/2015 Uno ..... H01R 13/6592 439/607.55
9,033,734 B2 * 5/2015 Tanaka ..... H01R 9/032 439/587
9,048,587 B2 * 6/2015 Marsh ..... H01R 11/12
9,059,534 B2 * 6/2015 Endo ..... H01R 13/52
9,065,194 B2 * 6/2015 Suzuki ..... H01R 4/34
9,083,107 B2 * 7/2015 Suzuki ..... H01R 13/5219
9,099,815 B2 * 8/2015 Kashiwada ..... H01R 23/7073
9,112,397 B2 * 8/2015 Kobayashi ..... H01R 9/24
9,228,605 B2 * 1/2016 Takemura ..... H01R 9/18
9,281,578 B2 * 3/2016 Kusamaki ..... H01R 9/24
9,293,856 B2 * 3/2016 Shigeta ..... H01R 13/5202
9,312,626 B2 * 4/2016 Itsuki ..... H01R 13/5208
9,312,646 B2 * 4/2016 Kuji ..... H01R 24/28
9,318,849 B2 * 4/2016 Kobayashi ..... H01R 13/5205
9,362,653 B2 * 6/2016 Tanaka ..... H01R 13/713
9,368,902 B2 * 6/2016 Nakai ..... H01R 13/5202
9,379,476 B2 * 6/2016 Tanaka ..... H01R 13/405
9,490,564 B2 * 11/2016 Nakayama ..... H01R 43/20
9,564,706 B2 * 2/2017 Ozawa ..... H01R 4/301
9,601,863 B2 * 3/2017 Takemura ..... H01R 13/5202
9,722,361 B2 * 8/2017 Tanaka ..... H01R 13/6581
9,762,004 B2 * 9/2017 Bower ..... H01R 13/6599
9,929,491 B2 * 3/2018 Yamaguchi ..... H01R 11/12
2009/0137153 A1 * 5/2009 Yoshioka ..... H01R 4/185 439/607.24
2013/0092412 A1 * 4/2013 Tanaka ..... H01R 13/6592 174/78
2013/0095704 A1 * 4/2013 Awakura ..... H01R 4/30 439/709
2014/0287631 A1 * 9/2014 Tashiro ..... H01R 13/521 439/733.1
2014/0305696 A1 * 10/2014 Tanaka ..... H01R 12/594 174/71 R
2015/0126055 A1 * 5/2015 Morita ..... H01R 13/5202 439/323
2018/0076534 A1 * 3/2018 Okamoto ..... H01R 4/30

FOREIGN PATENT DOCUMENTS

JP 2009-64572 3/2009
JP 2011076886 A 4/2011
JP 2011-198676 10/2011
JP 2015-18695 1/2015

* cited by examiner

CONNECTOR

BACKGROUND

Field of the Invention

The invention relates to a connector.

Description of the Related Art

Japanese Unexamined Patent Publication No. 2015-18695 is an example of a known shield connector that is to be inserted into a mounting hole provided in a casing of a device. The shield connector includes a housing made of synthetic resin, a base-end side terminal to be connected to an end of a wire and a tip side terminal to be connected to the base-end side terminal. The tip side terminal includes a coupling plate to be connected to the base-end side terminal and a connecting piece to be connected to a mating terminal mounted in a device-side connector. The base-end side terminal and the coupling plate are connected by bolting, and a work opening for this bolting is open in the upper surface of the housing. After bolting, water is shut off from the interior of the housing by mounting a service cover on the work opening.

In the above shield connector, since a connected part of the connecting piece of the tip side terminal and the base-end side terminal are hidden below the housing, it is not possible to visually confirm through the work opening whether the connecting piece of the tip side terminal and the base-end side terminal are properly connected. Accordingly, the connecting piece of the tip side terminal is formed in an L shape and a connecting method to the mating terminal to bolting is changed. If these are employed, it is possible to align the connecting piece of the tip side terminal and the mating terminal and perform bolting while confirming through the work opening. However, in this case, bolting is performed at two positions, thereby increasing the number of components and increasing bolting operations. Further, since a tool space for performing bolting needs to be provided for two positions, the work opening becomes larger, leading to the enlargement of the housing.

SUMMARY

A connector disclosed by this specification is a connector to be mounted on a casing of a device by being inserted into a mounting hole provided in the casing. The connector includes a terminal connected to a wire, a housing having the terminal mounted therein, and an intermediate terminal made of metal, mounted in the housing and disposed between the terminal and a mating terminal in the casing. A fastened component disposed in the casing and configured to be fastened to a fastening component, the mating terminal, the intermediate terminal and the terminal are arranged side by side in a fastening direction. The terminal and the mating terminal are connected via the intermediate terminal by being collectively fastened by the fastening component and the fastened component.

According to this configuration, the terminal and the intermediate terminal can be connected and the intermediate terminal and the mating terminal can be connected only by fastening the fastening component and the fastened component. Further, the fastening component can be fastened to the fastened component while a center position of the fastened component is confirmed through the intermediate terminal. A collar may be used as an example of such an intermediate terminal. That is, the terminal and the mating terminal can be conductively connected via the intermediate terminal. Thus, fastening can be performed at one position while the visibility of a fastening operation is ensured. The number of the fastening components and the fastened components can be reduced as compared to the case where fastening is performed at two positions, and the fastening operation can be reduced.

Further, an increase of contact resistance can be prevented by reliably fastening the terminal, the intermediate terminal and the mating terminal with the fastening component and the fastened component. Furthermore, the intermediate terminal is required to have sufficient rigidity to not be deformed by the fastening of the fastening component and the fastened component and has a larger cross-sectional area than the terminal and the mating terminal. However, conductor resistance decreases as the cross-sectional area increases. This is preferable particularly for connectors for high current since leading also to the suppression of heat generation.

The connector disclosed by this specification may be configured as follows.

The housing may include a work opening through which a fastening surface of the intermediate terminal to the fastening component is exposed to the outside of the housing. The work opening may be closed by a cover with the fastening component fastened to the fastened component.

According to this configuration, since it is sufficient to provide only one tool space for fastening, the work opening can be made smaller, leading to the miniaturization of the housing, as compared to the case where tool spaces are provided at two positions.

The intermediate terminal may have a hollow cylindrical shape, include an intermediate terminal body having an axial center extending in the fastening direction and a flange portion projecting radially outward from the intermediate terminal body, and be supported in the housing by the flange portion.

According to this configuration, the detachment of the intermediate terminal can be prevented by the flange portion. Further, if the position of the fastened component varies within the range of a tolerance in the fastening direction (vertical direction) in the casing, the tolerance can be absorbed by the intermediate terminal moving upward with respect to the housing.

The fastening component may be a bolt, the intermediate terminal may include an insertion hole through which the bolt is inserted. A clearance may be set between the bolt and an inner peripheral surface of the insertion hole in a direction perpendicular to the fastening direction.

According to this configuration, if the bolt varies in the direction perpendicular to the fastening direction as the position of the fastened component varies within the range of the tolerance in the direction perpendicular to the fastening direction in the casing, interference between the bolt and the inner peripheral surface of the insertion hole can be avoided and the bolt can be fastened to the fastened component.

The terminal may include a through hole through which the bolt is inserted, and a clearance may be set between the bolt and an inner peripheral surface of the terminal through hole in a direction perpendicular to the fastening direction.

According to this configuration, if the bolt varies in the direction perpendicular to the fastening direction as the position of the fastened component varies within the range of the tolerance in the direction perpendicular to the fastening direction in the casing, interference between the bolt and the terminal through hole inner peripheral surface can be avoided and the bolt can be fastened to the fastened component.

According to the connector disclosed by this specification, fastening can be performed at one position while the visibility of a fastening operation is ensured. The number of fastening components and fastened components can be reduced as compared to the case where fastening is performed at two positions, and the fastening operation can be reduced.

DETAILED DESCRIPTION

Figure 1:
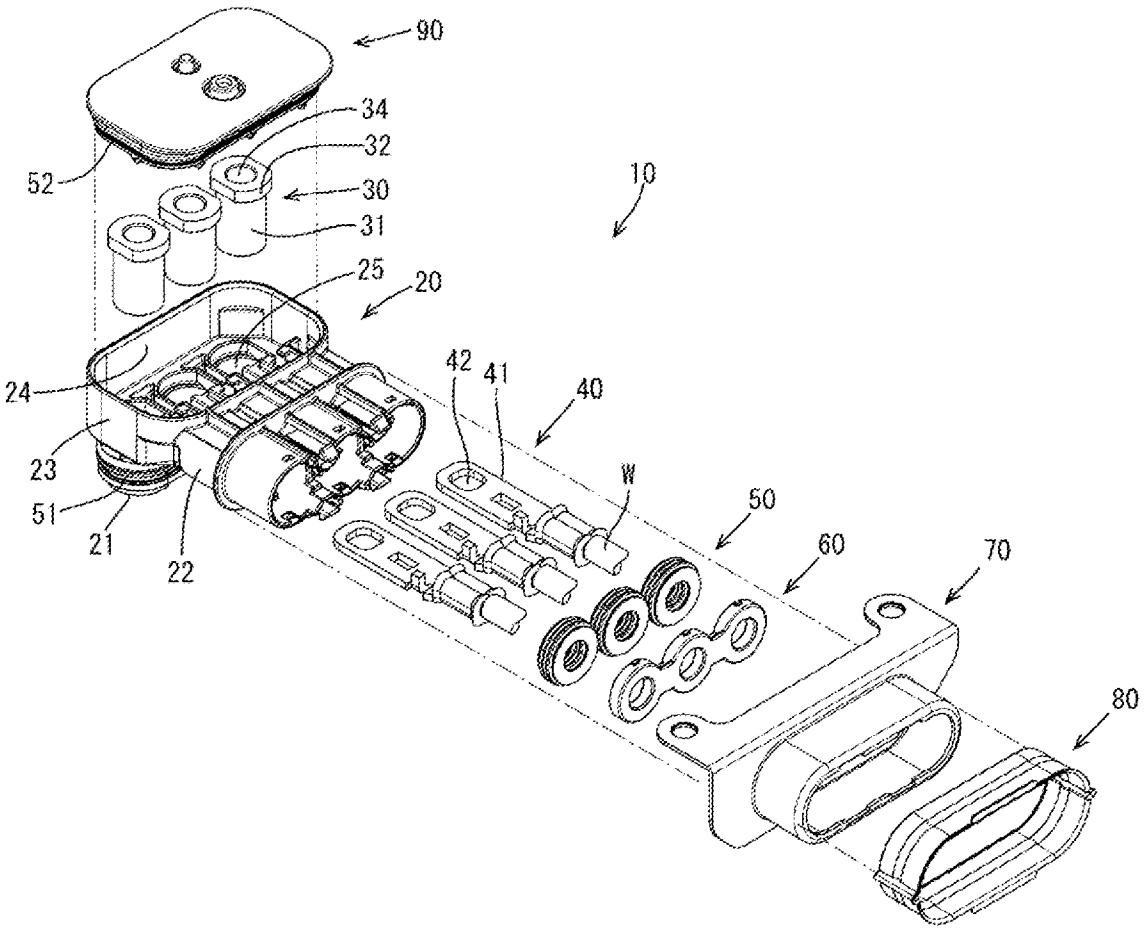
FIG. 1 is an exploded perspective view showing constituent components of a connector in an embodiment.
Figure 13:
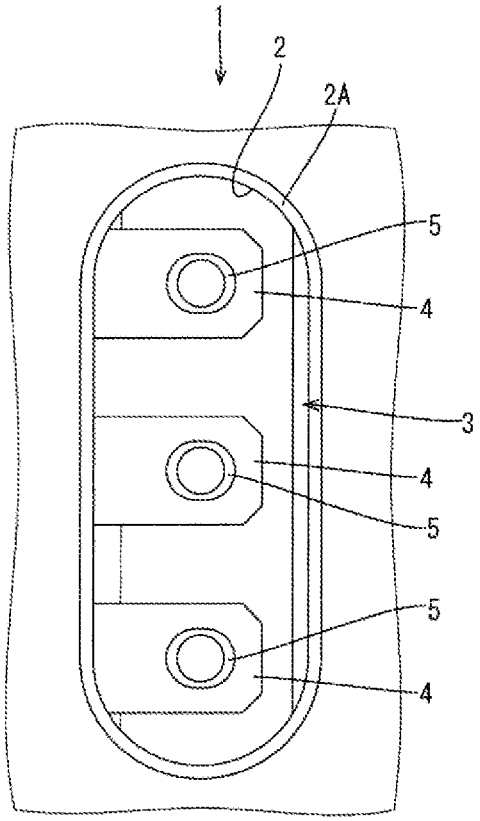
FIG. 13 is a plan view of the mounting hole of the casing viewed from above.
Figure 14:
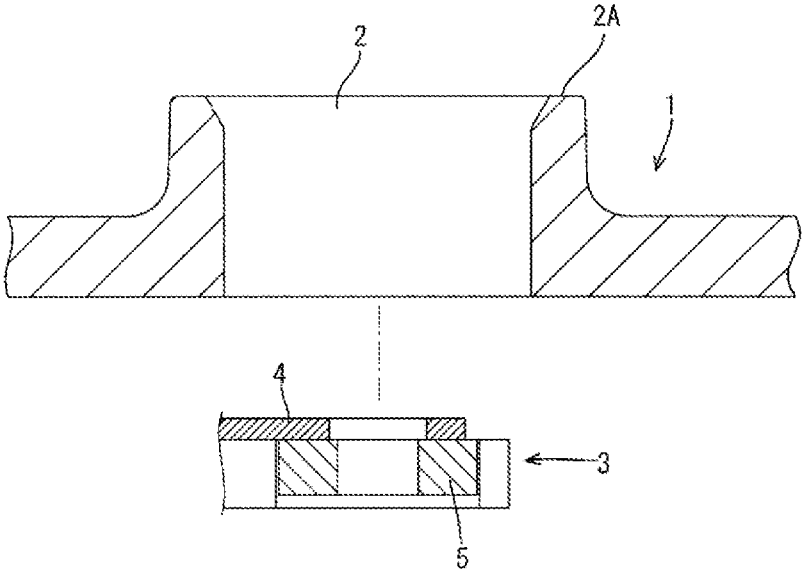
FIG. 14 is a section showing an internal structure of the casing.

An embodiment is described with reference to FIGS. 1 to 14. A connector 10 of this embodiment is a shield connector for high current to be mounted on a casing 1 of a device such as an inverter and includes, as shown in FIG. 1, a housing 20, a plurality of hollow cylindrical intermediate terminals (hereinafter, abbreviated as "intermediate terminals") 30, a plurality of terminals 40, a plurality of rubber plugs 50, a back retainer 60, a shield shell 70, a crimp ring 80, a cover 90 and the like. Alternatively, as shown in FIGS. 13 and 14, a mounting hole 2 is provided to be open upward in the casing 1 of the device, and a terminal block 3, mating terminals 4 and the like are disposed below the mounting hole 2.

Figure 2:
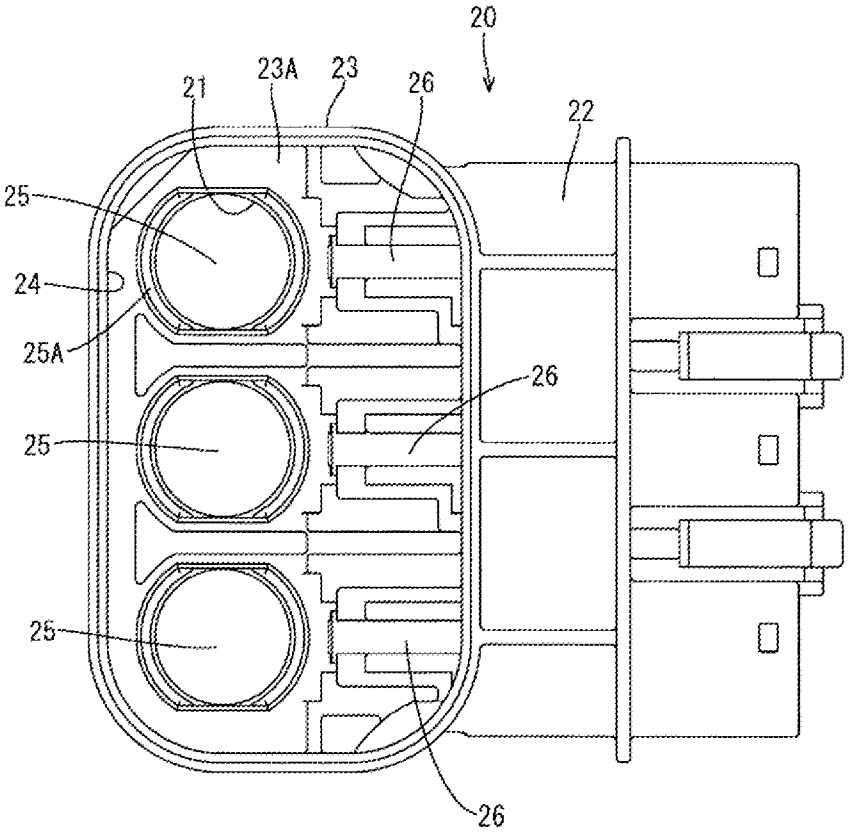
FIG. 2 is a plan view of a housing.

The housing 20 is made of synthetic resin and includes, as shown in FIG. 2, an intermediate terminal mounting portion 21 into which the intermediate terminals 30 are mounted, a terminal mounting portion 22 into which the terminals 40 are mounted and a cover mounting portion 23 into which the cover 90 is mounted. A work opening 24 is provided to be open upward in the cover mounting portion 23. A plurality of mounting holes 25 for mounting the plurality of intermediate terminals 30 are provided to penetrate through the cover mounting portion 23 in a vertical direction. Each mounting hole 25 is exposed to above the mounting hole 2 (outside) through the work opening 24.

The intermediate terminal 30 is made of conductive metal and includes, as shown in FIG. 1, an intermediate terminal body 31 having a hollow cylindrical shape and extending in the vertical direction and a flange portion 32 projecting radially outward from an upper end part of the intermediate terminal body 31. The flange portion 32 has a substantially oval shape and facing parts thereof closest to adjacent flange portion(s) 32 are formed to be straight. Thus, the plurality of intermediate terminals 30 can be disposed at narrow intervals.

Figure 8:
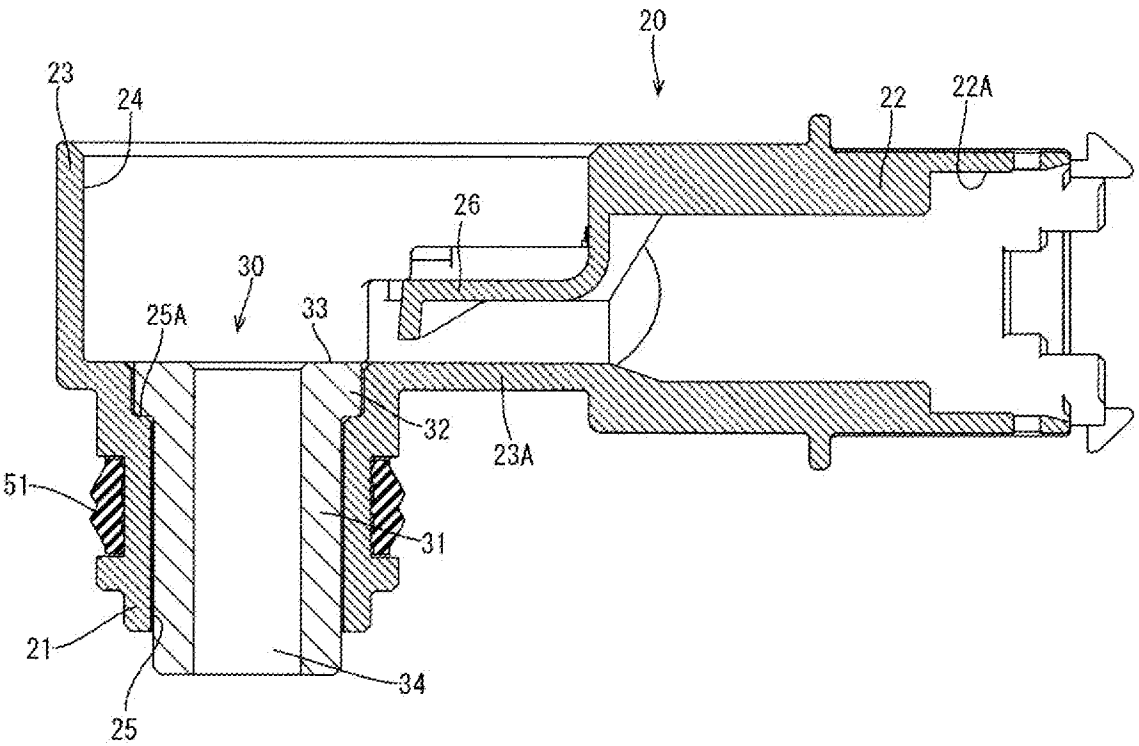
FIG. 8 is a section showing the state where the hollow cylindrical intermediate terminals are mounted into the housing from a state of FIG. 7.

As shown in FIG. 8, an opening edge part 25A of the mounting hole 25 in the intermediate terminal mounting portion 21 is widened to have a larger diameter than the mounting hole 25, and prevents the intermediate terminal 30 from being detached downward by locking the flange portion 32 from below. In a state where the flange portion 32 is supported by the opening edge part 25A with an axial center of the intermediate terminal 30 extending in the vertical direction (fastening direction), a lower end part of the intermediate terminal body 31 is disposed to project downward from a lower end part of the intermediate terminal mounting portion 21 and be exposed to outside. On the other hand, a fastening surface 33 located on an upper end side of the intermediate terminal 31 is facing outside through the work opening 24 of the housing 20.

Figure 12:
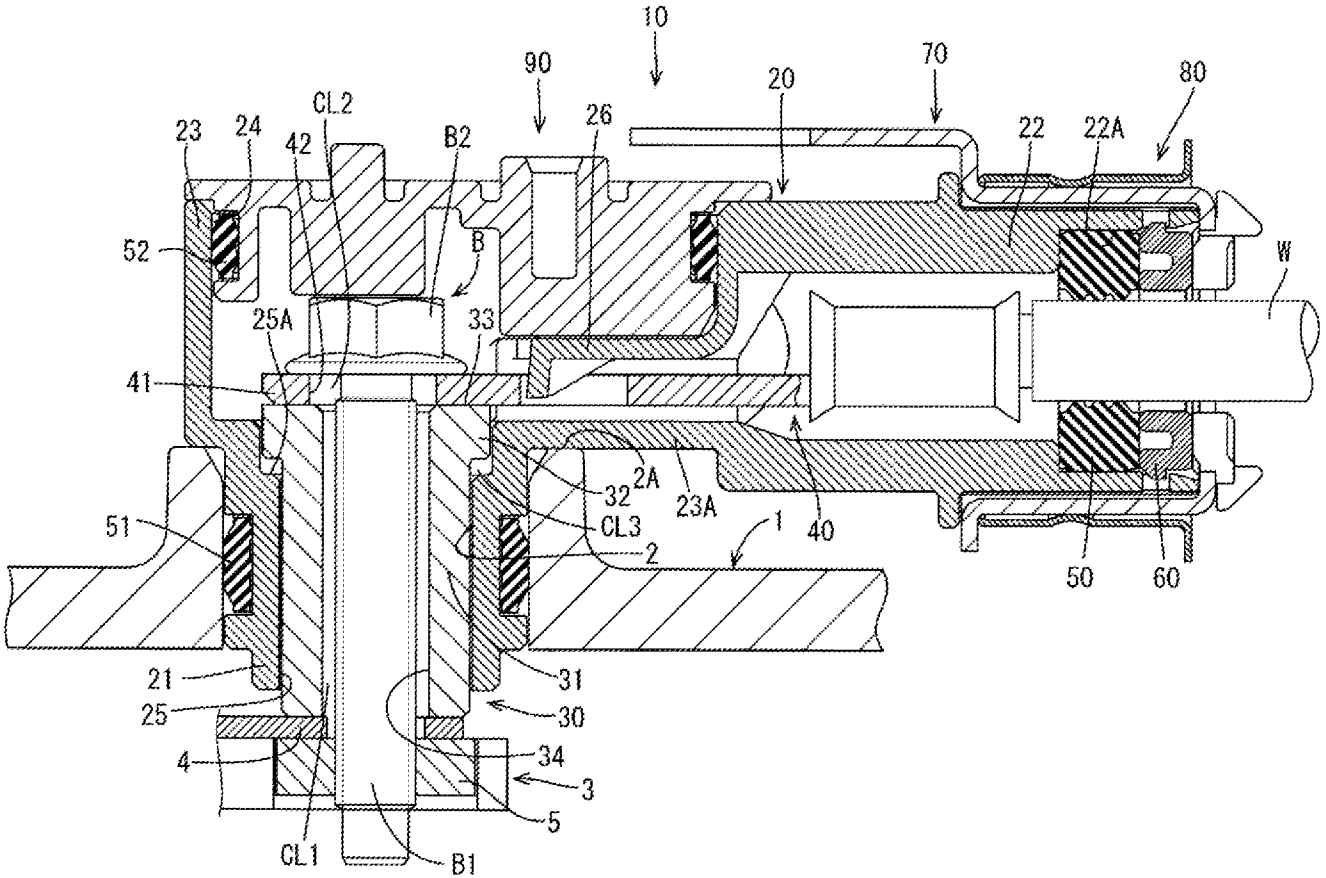
FIG. 12 is a section showing a state where the cover is mounted in a work opening from the state of FIG. 11.

As shown in FIG. 12, a first rubber ring 51 is fit on the outer peripheral surface of the intermediate terminal mounting portion 21. When the intermediate terminal mounting portion 21 is inserted into the mounting hole 2, the first rubber ring 51 is sandwiched between the outer peripheral surface of the intermediate terminal mounting portion 21 and the inner peripheral surface of the mounting hole 2. Thus, the intrusion of water into the interior of the casing 1 through the mounting hole 2 can be prevented. Similarly, a second rubber ring 52 is fit on the outer peripheral surface of the cover 90. When the cover 90 is inserted into the work opening 24, the second rubber ring 52 is sandwiched between the outer peripheral surface of the cover 90 and the inner peripheral surface of the work opening 24. Accordingly, the intrusion of water into the interior of the housing 20 through the work opening 24 can be prevented.

The terminal 40 is a round terminal and connected to an end of a wire W, and the rubber plug 50 is externally fit on the wire W. This rubber plug 50 is fit into an opening edge part 22A of the terminal mounting portion 22. Further, the back retainer 60 is mounted behind the rubber plug 50 in the opening edge part 22A of the terminal mounting portion 22, and the rubber plug 50 is retained by this back retainer 60. The rubber plug 50 is sandwiched between the outer peripheral surface of the wire W and the inner peripheral surface of the opening edge part 22A. Thus, the intrusion of water into the interior of the housing 20 through a rear end opening of the terminal mounting portion 22 can be prevented.

The shield shell 70 is externally fit on the outer peripheral surface of the terminal mounting portion 22. Further, the crimp ring 80 is externally fit on the outer peripheral surface of the shield shell 70 and an unillustrated shield member is crimped and connected to the outer peripheral surface of the shield shell 70 by crimping this crimp ring 80.

The terminal 40 includes a connecting portion 41 to be fastened to the fastening surface 33 of the intermediate terminal 30 by a bolt B. The connecting portion 41 is provided with a through hole 42 through which a shaft portion B1 of the bolt B penetrates. A washer is integrally incorporated into a head portion B2 of the bolt B. The connecting portion 41 is sandwiched and pressed between the head portion B2 and the fastening surface 33 of the intermediate terminal 30 by the washer part of the head portion B2 being pressed by the connecting portion 41. As a result, the intermediate terminal 30 and the terminal 40 are conductively connected.

The intermediate terminal 30 is provided with an insertion hole 34 into which the shaft portion B1 of the bolt B is inserted. The insertion hole 34 penetrates through both the intermediate terminal body 31 and the flange portion 32. The shaft portion B1 inserted into the insertion hole 34 projects downward from the lower end of the intermediate terminal body 31, and is fastened to a nut 5 constituting the terminal block 3 in the casing 1. In this way, the mating terminal 4 is sandwiched and pressed between the intermediate terminal body 31 and the nut 5 to conductively connect the intermediate terminal 30 and the mating terminal 4.

A clearance CL1 is set between the inner peripheral surface of the insertion hole 34 of the intermediate terminal 30 and the shaft portion B1 of the bolt B. The clearance CL1 is provided to prevent the shaft portion B1 of the bolt B and the inner peripheral surface of the insertion hole 34 from interfering with each other when the position of the shaft portion B1 of the bolt B varies in a direction perpendicular to the fastening direction. That is, the position of the shaft portion B1 of the bolt B is determined by the position of the nut 5, but a center of the nut 5 and that of the mounting hole 2 of the casing 1 are not necessarily coaxially arranged. If T1 denotes a deviation tolerance between the center of the nut 5 and that of the mounting hole 2 of the casing 1 in the direction perpendicular to the fastening direction, the clearance CL1 is set to be larger than the tolerance T1.

Further, a clearance CL2 is set between the inner peripheral surface of the through hole 42 of the terminal 40 and the shaft portion B1 of the bolt B. The clearance CL2 is provided to prevent the shaft portion B1 of the bolt B and the inner peripheral surface of the through hole 42 from interfering with each other when the position of the shaft portion B1 of the bolt B varies in the direction perpendicular to the fastening direction. The clearance CL2 is set to be larger than the tolerance T1 and larger than the clearance CL1. The clearance CL2 is larger than the clearance CL1 because a tolerance T3 due to a variation of the position of the terminal 40 with respect to the fastening surface 33 of the intermediate terminal 30 in the direction perpendicular to the fastening direction needs to be considered in addition to the tolerance T1.

Figure 10:
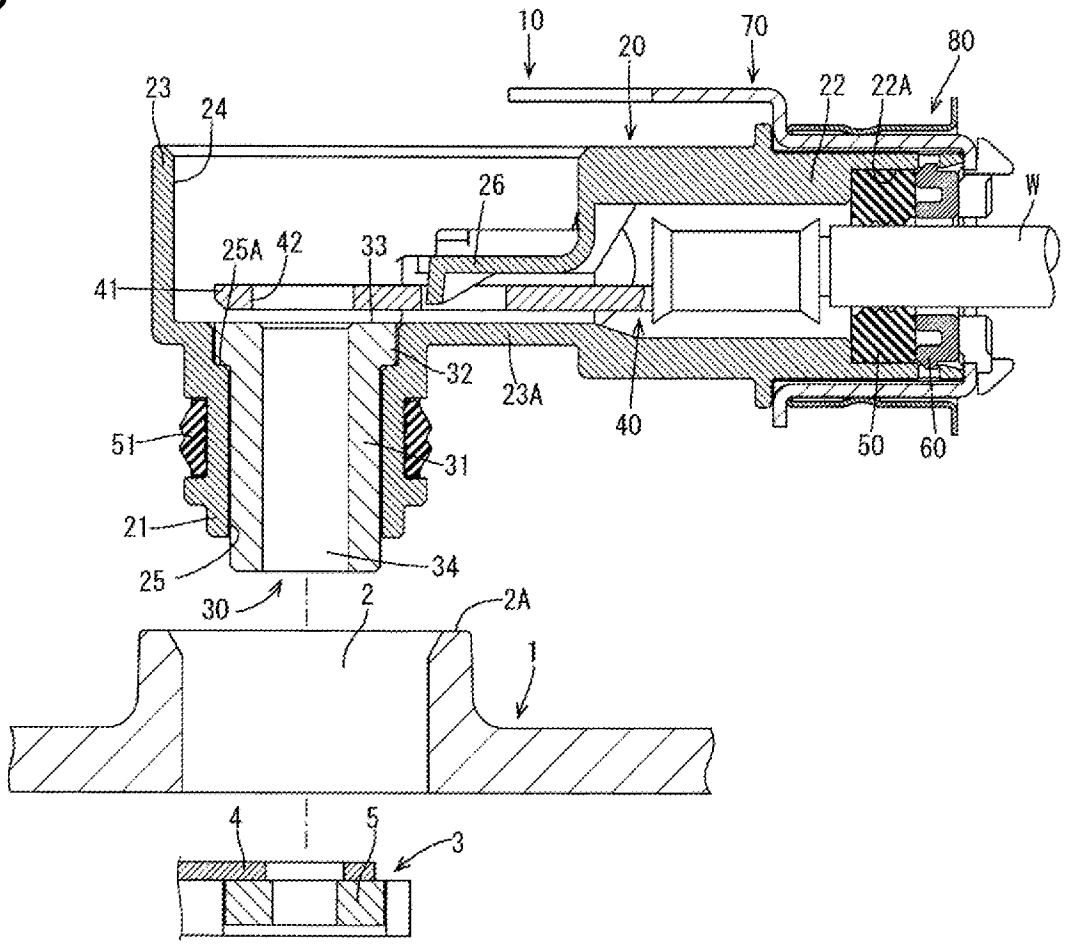
FIG. 10 is a section showing a state where the housing is mounted on a casing by being inserted into a mounting hole from the state of FIG. 9.

Further, as shown in FIG. 10, a clearance CL3 is set between the upper surface of the flange portion 32 and the lower surface of the connecting portion 41 of the terminal 40 with the flange portion 32 supported by the opening edge part 25A of the mounting hole 25. Specifically, the intermediate terminal 30 is vertically movable by the clearance CL3. This clearance CL3 is provided to avoid a situation in which the bolt B cannot be fastened to the nut 5 when the position of the nut 5 varies in the fastening direction of the bolt B. The position of the nut 5 is determined by the position of the terminal block 3, but a dimension from the upper surface of the nut 5 to the upper surface of an opening part of the mounting hole 2 of the housing 1 is not necessarily constant. If T2 denotes a deviation tolerance (tolerance of a dimension from the upper surface of the nut 5 to the upper surface of an opening edge part 2A of the mounting hole 2) of the nut 5 with respect to the casing 1 in the fastening direction, the above clearance CL3 is set to be larger than the tolerance T2.

As just described, in this embodiment, the terminal 40, the intermediate terminal 30 and the mating terminal 4 are fastened together by one bolt B1 and one nut 5. In other words, the terminal 40 and the mating terminal 4 are joined and connected by the intermediate terminal 30, and contact resistance in connected parts can be reduced by sandwiching and pressing the terminal 40, the intermediate terminal 30 and the mating terminal 4 between the head portion B2 of the bolt B and the nut 5. Further, the intermediate terminal 30 is required to have rigidity sufficient to not be deformed by bolting. As a result, the intermediate terminal 30 has a larger cross-sectional area than the terminal 40 and a busbar (mating terminal 4), but conductor resistance decreases as the cross-sectional area increases. Thus, resistance in the entire intermediate terminal 30 can be reduced by reducing both the contact resistance and the conductor resistance. Therefore, heat generation is easily suppressed. That is, in the connector 10 for high current, the intermediate terminals 30 can be said to be optimal joint connection components.

Further, although the intermediate terminal 30 has a larger cross-sectional area than the terminal 40 and the mating terminal 4, an outer diameter of the intermediate terminal 30 is suppressed to be substantially equal to a flange outer diameter of the nut 5 and the intermediate terminal 30 does not laterally protrude from a side surface of the nut 5. This contributes to space saving in the direction perpendicular to the fastening direction. Thus, the shaft portions B1 of the bolts B, the intermediate terminals 30, the intermediate terminal mounting portion 21 and the first rubber ring 51 can be coaxially and densely arranged inside the mounting hole 2, therefore leading to a size reduction of the mounting hole 2 and, the miniaturization of the casing 1.

Figure 3:
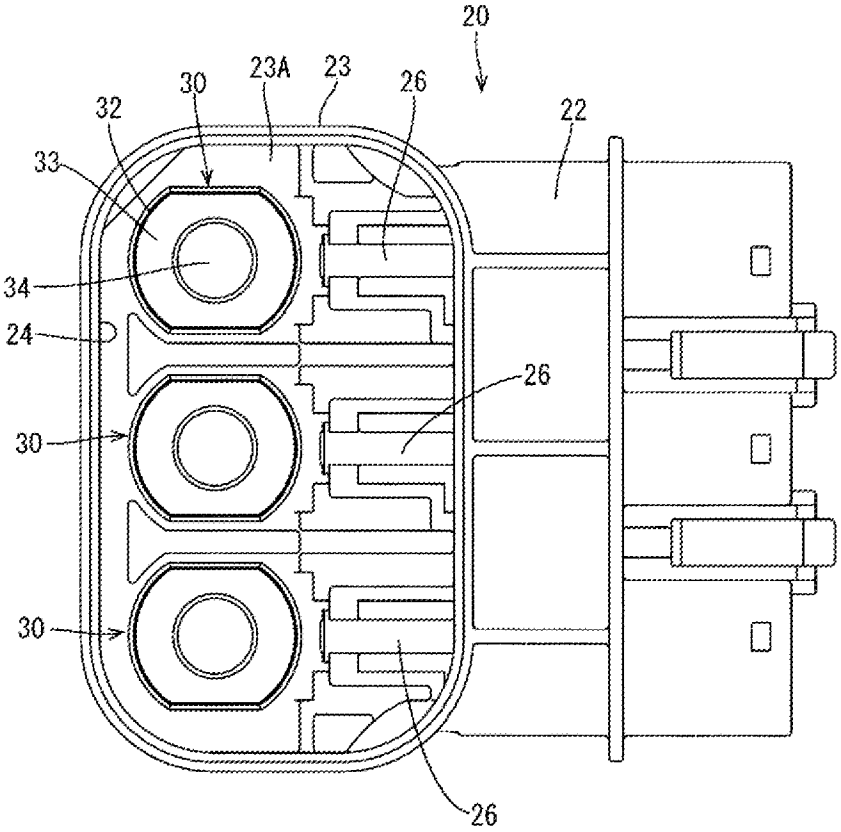
FIG. 3 is a plan view showing a state where hollow cylindrical intermediate terminals are mounted into the housing from a state of FIG. 2.
Figure 4:
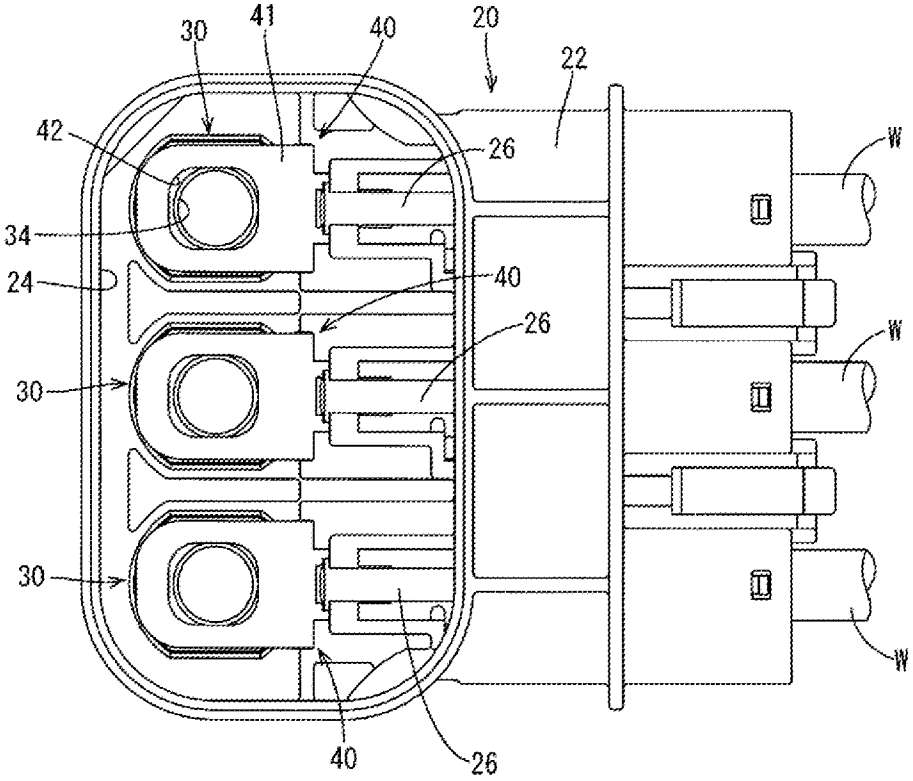
FIG. 4 is a plan view showing a state where terminals are mounted into the housing from the state of FIG. 3.
Figure 5:
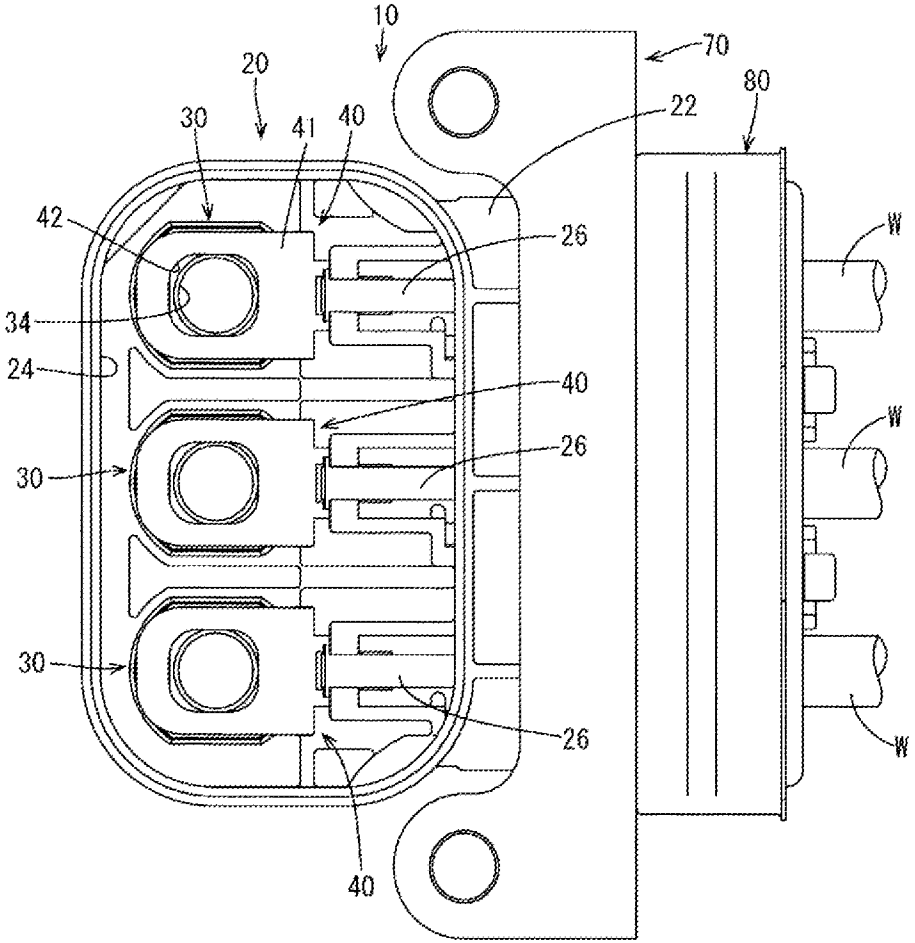
FIG. 5 is a plan view showing a state where a shield shell and a crimp ring are mounted on the housing from the state of FIG. 4.
Figure 6:
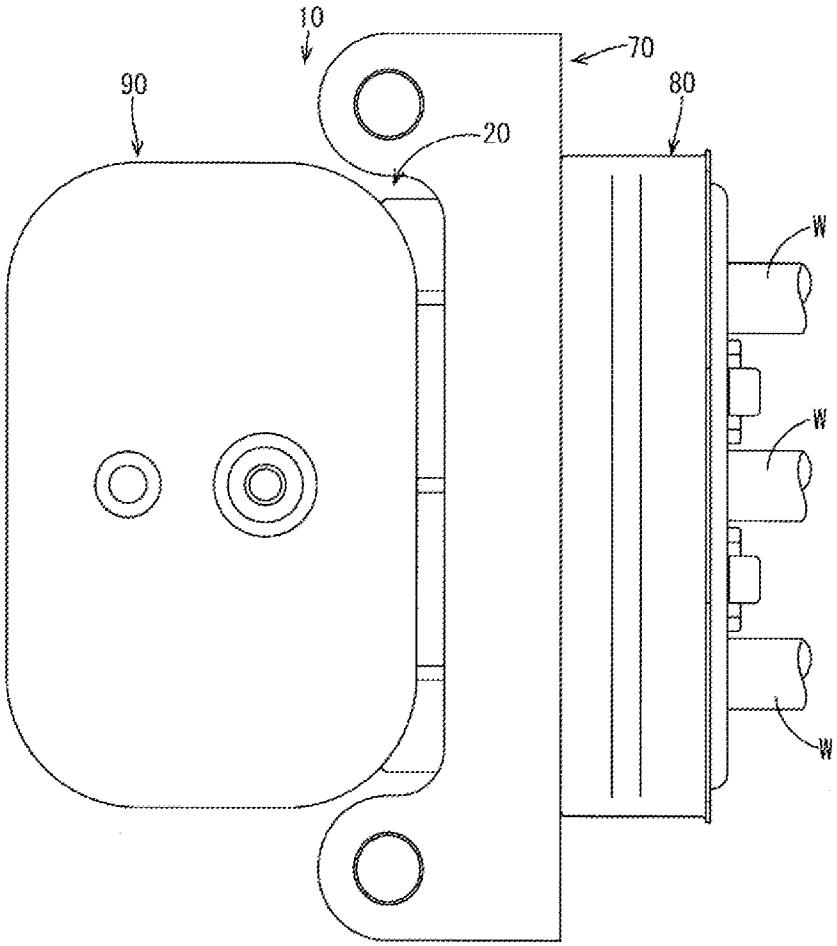
FIG. 6 is a plan view showing a state where a cover is mounted on the housing from the state of FIG. 5.
Figure 7:
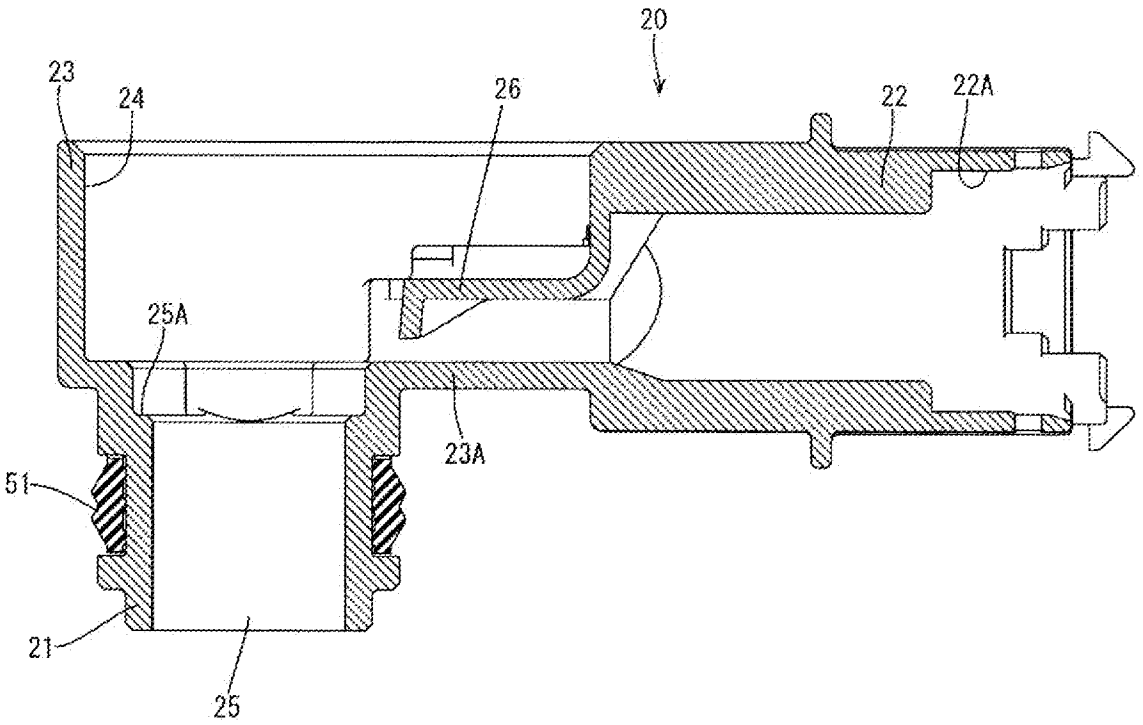
FIG. 7 is a section showing an internal structure of the housing.

This embodiment is configured as described above. Next, an assembling procedure of the connector 10 is described. As shown in FIG. 7, the first rubber ring 51 is fit on the outer peripheral surface of the intermediate terminal mounting portion 21 of the housing 20. Subsequently, as shown in FIGS. 3 and 8, the plurality of intermediate terminals 30 are inserted into the respective mounting holes 25 and mounted in the intermediate terminal mounting portion 21. At this time, the intermediate terminals 30 are inserted until the flange portions 32 are fit into the opening edge parts 25A of the mounting holes 25, whereby the respective intermediate terminals 30 are circumferentially positioned. Further, the flange portions 32 are supported from below by the opening edge parts 25A of the mounting holes 25, whereby the detachment of the respective intermediate terminals 30 is prevented.

Figure 9:
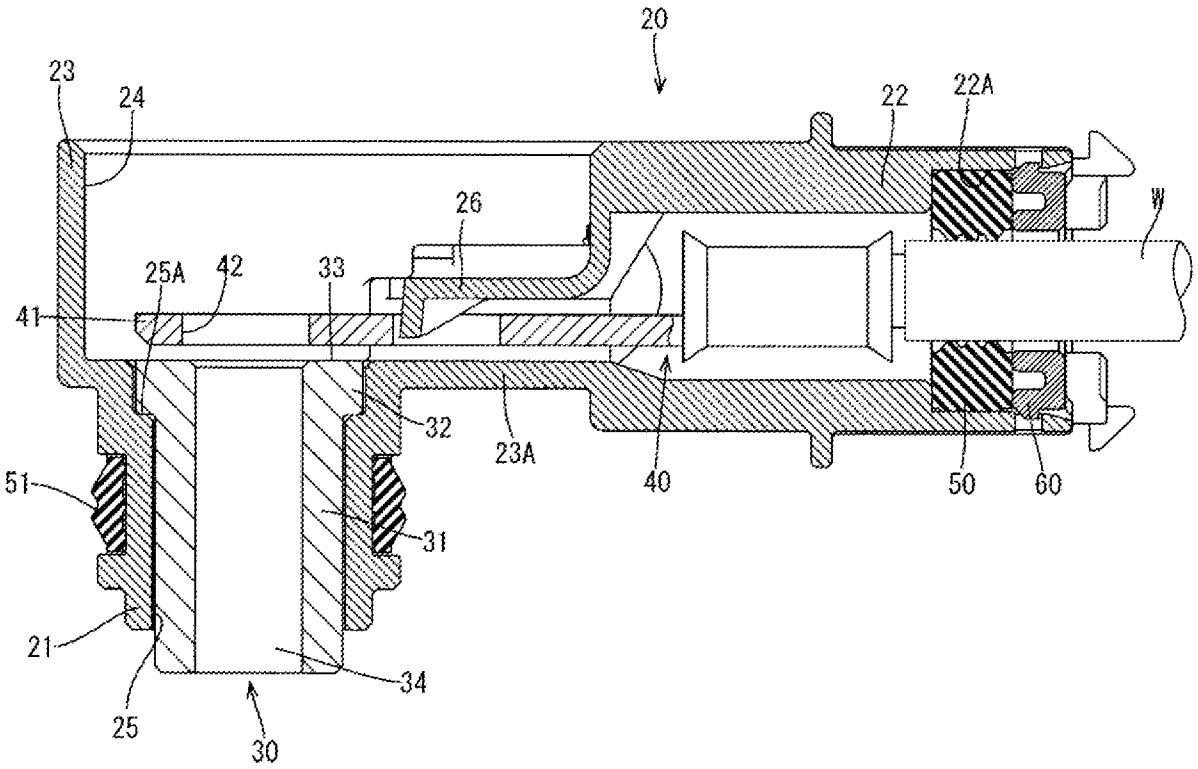
FIG. 9 is a section showing the state where the terminals are mounted into the housing from the state of FIG. 8.

Subsequently, when the terminals 40 are inserted into the terminal mounting portion 22 as shown in FIG. 9, the terminals 40 are retained by locking lances 26 provided in the terminal mounting portion 22. Further, the rubber plugs 50 mounted on the wires W in advance and the back retainer 60 are mounted to the opening edge part 22A of the terminal mounting portion 22 from behind. Subsequently, as shown in FIG. 10, the shield shell 70 is fit on the outer peripheral surface of the terminal mounting portion 22 and an unillustrated braided wire is crimped to the shield shell 70 by the crimp ring 80. In this way, the connector 10 is assembled.

Figure 11:
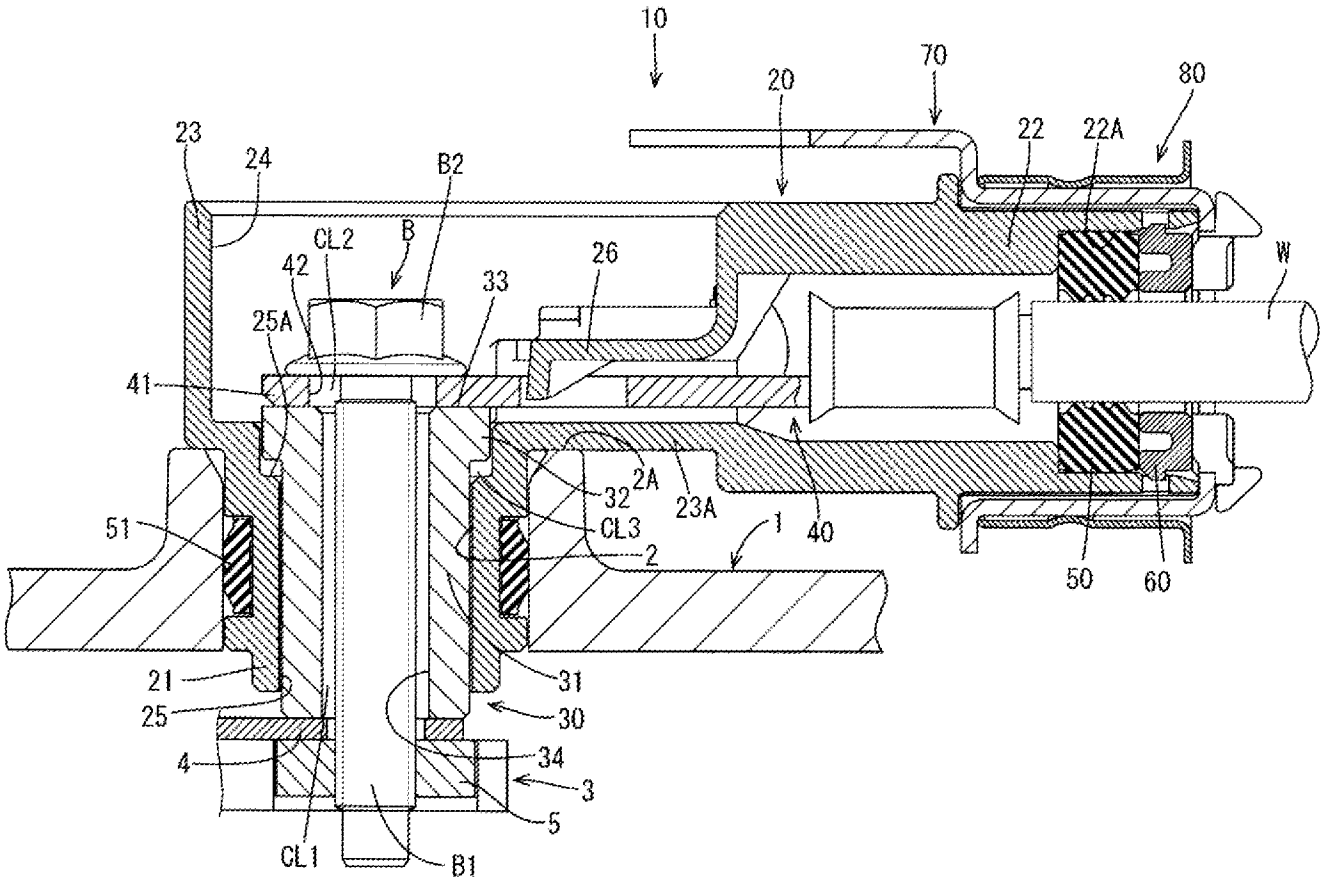
FIG. 11 is a section showing a state where a bolt is fastened from the state of FIG. 10.

Next, how to mount the connector 10 on the casing 1 is briefly described. As the intermediate terminal mounting portion 21 is inserted into the mounting hole 2, the first rubber ring 51 is sandwiched between the outer peripheral surface of the intermediate terminal mounting portion 21 and the inner peripheral surface of the mounting hole 2 as shown in FIG. 11. In the process of inserting the intermediate terminal mounting portion 21, lower end parts of the intermediate terminals 30 come into contact with the mating terminals 4. As the insertion further continues, the intermediate terminals 30 move upward with respect to the intermediate terminal mounting portion 21. During this time, the intermediate terminal mounting portion 21 is inserted until a bottom wall 23A of the cover mounting portion 23 butts against the opening edge part 2A of the mounting hole 2 while absorbing the tolerance T2 of the position of the nut 5 in the fastening direction. When the insertion of the intermediate terminal mounting portion 21 is completed, the connecting portions 41 of the terminals 40, the intermediate terminals 30 and the mating terminals 4 are arranged side by side in the fastening direction of the bolts B.

Subsequently, the bolt B is inserted toward the nut 5. Even if the position of the nut 5 is deviated in the direction perpendicular to the fastening direction, that tolerance T1 is absorbed by the clearance CL1. Thus, the bolt B can be inserted without the shaft portion B1 of the bolt B interfering with the inner peripheral surface of the insertion hole 34. At this time, by inserting the shaft portion B1 of the bolt B into the insertion hole 34 and fastening the shaft portion B1 to the nut 5 while visually confirming a center position of the nut 5 through the insertion hole 34 of the intermediate terminal 30, the terminal 40, the intermediate terminal 30 and the mating terminal 4 are collectively fastened by the bolt B and the nut 5, and the terminal 40 and the mating terminal 4 are conductively connected via the intermediate terminal 30. Subsequently, as the cover 90 is fit into the work opening 24 of the cover mounting portion 23 and the work opening 24 is closed by the cover 90 as shown in FIG. 12, the second rubber ring 52 is sandwiched between the outer peripheral surface of the cover 90 and the inner peripheral surface of the work opening 24. In this way, the connector 10 is mounted on the casing 1 in a sealed state.

As described above, in this embodiment, the terminal 40 and the intermediate terminal 30 can be connected and the intermediate terminal 30 and the mating terminal 4 can be connected only by fastening a fastening component (bolt B) and a fastened component (nut 5). Further, the fastening component can be fastened to the fastened component while a center position of the fastened component is confirmed through the intermediate terminal 30. A collar may be used as an example of such an intermediate terminal 30. The intermediate terminal 30 is used as an intermediate terminal for connecting the terminal 40 and the mating terminal 4 to each other, and the terminal 40 and the mating terminal 4 can be conductively connected via the intermediate terminal 30. Thus, fastening can be performed at one position while the visibility of the fastening operation is ensured, the number of the fastening component and the fastened component can be reduced as compared to the case where fastening is performed at two positions, and the fastening operation can be reduced.

Further, an increase of contact resistance can be prevented by reliably fastening the terminal 40, the intermediate terminal 30 and the mating terminal 4 by the fastening component and the fastened component. Further, the intermediate terminal 30 is required to have rigidity sufficient not to be deformed by the fastening of the fastening component and the fastened component and inevitably has a larger cross-sectional area than the terminal 40 and the mating terminal 4. However, the conductor resistance decreases as the cross-sectional area increases. This is preferable particularly for the connector 10 for high current since leading also to the suppression of heat generation.

Further, the housing 20 may include the work opening 24 through which the fastening surface of the intermediate terminal 30 to the fastening component is exposed to outside, and the work opening 24 may be closed by the cover 90 with the fastening component fastened to the fastened component.

According to this configuration, since it is sufficient to provide only one tool space for fastening, the work opening 24 can be made smaller, leading to the miniaturization of the housing 20, as compared to the case where tool spaces are provided at two positions.

The intermediate terminal 30 may have a hollow cylindrical shape, include the intermediate terminal body 31 having an axial center extending in the fastening direction and a flange portion 32 projecting radially outward from the intermediate terminal body 31 and be supported in the housing 20 by the flange portion 32.

According to this configuration, the detachment of the intermediate terminal 30 can be prevented by the flange portion 32. Further, if the position of the fastened component varies within the range of the tolerance T2 in the fastening direction (vertical direction) in the casing 1, the tolerance T2 can be absorbed by the intermediate terminal 30 moving upward with respect to the housing 10.

The fastening component may be the bolt B, the intermediate terminal 30 may include the insertion hole 34 through which the bolt B is inserted, and the clearance CL1 may be set between the bolt B and the inner peripheral surface of the insertion hole 34 in the direction perpendicular to the fastening direction.

According to this configuration, if the bolt B varies in the direction perpendicular to the fastening direction as the position of the fastened component varies within the range of the tolerance T1 in the direction perpendicular to the fastening direction in the casing 1, it can be avoided that the bolt B interferes with the inner peripheral surface of the insertion hole 34 and cannot be fastened to the fastened component.

The fastening component may be the bolt B, the terminal 40 may include the through hole 42 through which the bolt B is inserted, and the clearance CL3 may be set between the bolt B and the inner peripheral surface of the through hole 42 in the direction perpendicular to the fastening direction.

According to this configuration, if the bolt B varies in the direction perpendicular to the fastening direction as the position of the fastened component varies within the range of the tolerance T1 in the direction perpendicular to the fastening direction in the casing 1, it can be avoided that the bolt B interferes with the inner peripheral surface of the through hole 42 and cannot be fastened to the fastened component.

The technique disclosed by this specification is not limited to the above described and illustrated embodiment. For example, the following modes are also included.

Although the nuts 5 are fixed to the terminal block 3 and the bolts B are fastened to the nuts 5 in the above embodiment, stud bolts may be fixed to the terminal block and nuts may be fastened to the stud bolts.

Although the housing 20 is provided with the work opening 24 in the above embodiment, the shield shell may be provided with a work opening.

Although the intermediate terminal 30 provided with the flange portion 32 is illustrated in the above embodiment, an intermediate terminal may have an inverted truncated conical shape and the detachment of a collar may be prevented by forming a mounting hole, into which the intermediate terminal is mounted, into a conical shape.

Although the bolt B is made freely movable by setting the clearance CL1 in the insertion hole 34 of the intermediate terminal 30 in the above embodiment, the intermediate terminal 30 may be made freely movable in accordance with the position of the bolt B by setting a clearance between the outer peripheral surface of the intermediate terminal body 31 and the inner peripheral surface of the mounting hole 25.

Although the bolt B is made freely movable by setting the clearance CL2 in the through hole 42 of the terminal 40 in the above embodiment, the terminal and the intermediate terminal may be integrally formed in advance and the integrated terminal and intermediate terminal may be made freely movable in accordance with the position of the bolt B instead of setting the clearance.

The invention claimed is:

1. A connector to be mounted on a casing of a device by being inserted into a mounting hole provided in the casing, the connector comprising:

a terminal connected to a wire;

a housing;

an intermediate terminal made of metal and disposed between the terminal and a mating terminal in the casing; and a cover;

wherein:

the housing integrally includes an intermediate terminal mounting portion into which the intermediate terminal is mounted, a terminal mounting portion into which the terminal is mounted and a cover mounting portion into which the cover is mounted;

a fastened component disposed in the casing and to be fastened to a fastening component, the mating terminal, the intermediate terminal and the terminal are arranged side by side in a fastening direction, and the terminal and the mating terminal are connected via the intermediate terminal by being collectively fastened by the fastening component and the fastened component; and a clearance is set between the intermediate terminal and the terminal before the fastening component is fastened, and the intermediate terminal is movable toward the terminal by the clearance during fastening.

2. The connector of claim 1, wherein the cover mounting portion includes a work opening through which a fastening surface of the intermediate terminal to the fastening component is exposed to outside, and the work opening is closed by the cover with the fastening component fastened to the fastened component.

3. The connector of claim 1, wherein the intermediate terminal has a hollow cylindrical shape, includes an intermediate terminal body having an axial center extending in the fastening direction and a flange portion projecting radially outward from the intermediate terminal body, and is supported in the housing by the flange portion.

4. The connector of claim 1, wherein the fastening component is a bolt, the intermediate terminal includes an insertion hole through which the bolt is inserted, and a clearance is set between the bolt and an inner peripheral surface of the insertion hole in a direction perpendicular to the fastening direction.

5. The connector of claim 1, wherein the fastening component is a bolt, the terminal includes a through hole through which the bolt is inserted, and a clearance is set between the bolt and an inner peripheral surface of the through hole in a direction perpendicular to the fastening direction.

* * * * *